US005250210A

United States Patent [19]

Von Culin

[11] Patent Number: 5,250,210

[45] Date of Patent: Oct. 5, 1993

[54] BAR SOAP CONSTRUCTION

[76] Inventor: Harvey J. Von Culin, 966 Blue Rock La., Blue Bell, Pa. 19422

[21] Appl. No.: 993,362

[22] Filed: Dec. 18, 1992

[51] Int. Cl.[5] ..... C11D 17/04

[52] U.S. Cl. ..... 252/90; 252/134; 252/91; 252/92; 252/174

[58] Field of Search ..... 252/90, 91, 92, 134, 252/174; 401/201

[56] References Cited

U.S. PATENT DOCUMENTS

| | | | |
|---|---|---|---|
| 821,245 | 5/1906 | Hutchinson | 252/90 |
| 1,495,978 | 6/1924 | Anderson | 252/134 |
| 2,988,841 | 6/1961 | Seufer et al. | 45/28 |
| 3,076,298 | 2/1963 | Tundermann | 53/24 |
| 3,283,357 | 11/1966 | Decker et al. | 15/506 |
| 3,293,684 | 12/1966 | Tundermann | 15/605 |
| 3,931,035 | 1/1976 | Brown | 252/134 |
| 4,203,857 | 5/1980 | Dugan | 252/92 |
| 4,240,760 | 12/1980 | Levine | 401/201 |

FOREIGN PATENT DOCUMENTS

| | | |
|---|---|---|
| 2329942 | 6/1973 | Fed. Rep. of Germany . |
| 006926 | 5/1973 | Switzerland . |

*Primary Examiner*—Paul Lieberman
*Assistant Examiner*—Michael Tierney
*Attorney, Agent, or Firm*—Leon Gilden

[57] ABSTRACT

A bar soap construction is arranged to include a bottom wall spaced from a top wall, spaced end walls, and spaced side walls, with the top wall including a top wall cavity having a cavity floor to accommodate prior soap components therewithin for reuse and remolding of the soap components within the top wall cavity. A modification of the invention includes an end wall cavity arranged for further receiving bar soap components and a cap member arranged to direct the components within the bar soap for reuse.

4 Claims, 4 Drawing Sheets

BAR SOAP CONSTRUCTION

BACKGROUND OF THE INVENTION

1. Field of the Invention

The field of invention relates to bar soap, and more particularly pertains to a new and improved bar soap construction arranged for the reclamation and reuse of prior bar soap components.

2. Description of the Prior Art

Bar soaps of various types have been utilized throughout the prior art for cleaning, wherein typically, components of such bar soaps are remaining and to be discarded. To minimize loss of such pieces, the bar soap of the instant invention attempts to provide for a cavity to accommodate in a moistened state prior bar soap pieces for the remolding into the bar soap construction of the invention for the reuse of such pieces and in this respect, the present invention substantially fulfills this need.

SUMMARY OF THE INVENTION

In view of the foregoing disadvantages inherent in the known types of bar soap structure now present in the prior art, the present invention provides a bar soap construction wherein the same includes at least one cavity arranged to accommodate prior bar soap pieces. As such, the general purpose of the present invention, which will be described subsequently in greater detail, is to provide a new and improved bar soap construction which has all the advantages of the prior art bar soap structure and none of the disadvantages.

To attain this, the present invention provides a bar soap construction arranged to include a bottom wall spaced from a top wall, spaced end walls, and spaced side walls, with the top wall including a top wall cavity having a cavity floor to accommodate prior soap components therewithin for reuse and remolding of the soap components within the top wall cavity. A modification of the invention includes an end wall cavity arranged for further receiving bar soap components and a cap member arranged to direct the components within the bar soap for reuse.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bar soap construction which has all the advantages of the prior art bar soap structure and none of the disadvantages.

It is another object of the present invention to provide a new and improved bar soap construction which may be easily and efficiently manufactured and marketed.

It is a further object of the present invention to provide a new and improved bar soap construction which is of a durable and reliable construction.

An even further object of the present invention is to provide a new and improved bar soap construction which is susceptible of a low cost of manufacture with regard to both materials and labor, and which accordingly is then susceptible of low prices of sale to the consuming public, thereby making such bar soap constructions economically available to the buying public.

Still yet another object of the present invention is to provide a new and improved bar soap construction which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view, taken along the lines 8—8 of FIG. 7 in the direction indicated by the arrows.

DESCRIPTION OF THE PREFERRED EMBODIMENT

Figure 1:
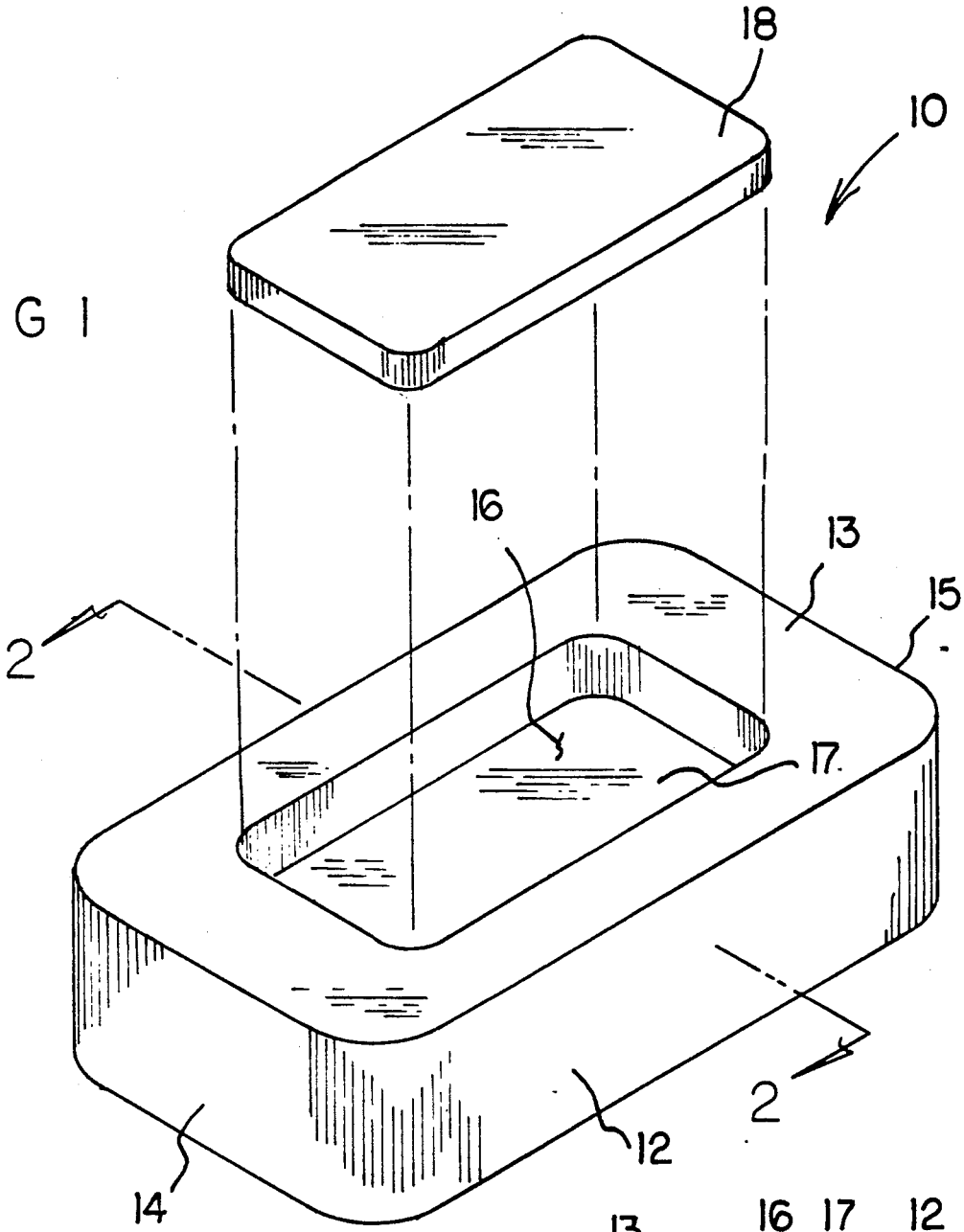
FIG. 1 is an isometric illustration of the invention.
Figure 2:
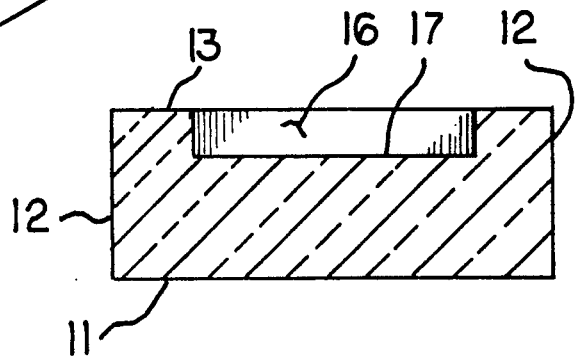
FIG. 2 is an orthographic view, taken along the lines 2—2 of FIG. 1 in the direction indicated by the arrows.

With reference now to the drawings, and in particular to FIGS. 1 to 9 thereof, a new and improved bar soap construction embodying the principles and concepts of the present invention and generally designated by the reference numerals 10 and 10*a* will be described.

More specifically, the bar soap construction 10 of the instant invention essentially comprises a bar soap member, having a bar bottom wall 11 spaced from a top wall 13, with spaced side walls 12, a first end wall 14 spaced from a second end wall 15. The top wall 13 includes a top wall cavity 16 directed therein, having a cavity floor 17 spaced from the bottom wall 11. To this end, soap pieces 13 are accumulated from prior bar soap members and directed into the bar soap cavity, particularly in a moistened condition for their remolding into the bar soap member 10 and their reuse.

Figure 4:
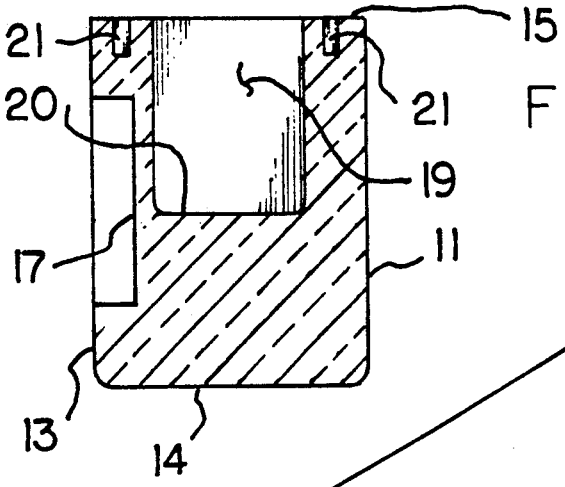
FIG. 4 is an orthographic view, taken along the lines 4—4 of FIG. 3 in the direction indicated by the arrows.
Figure 3:
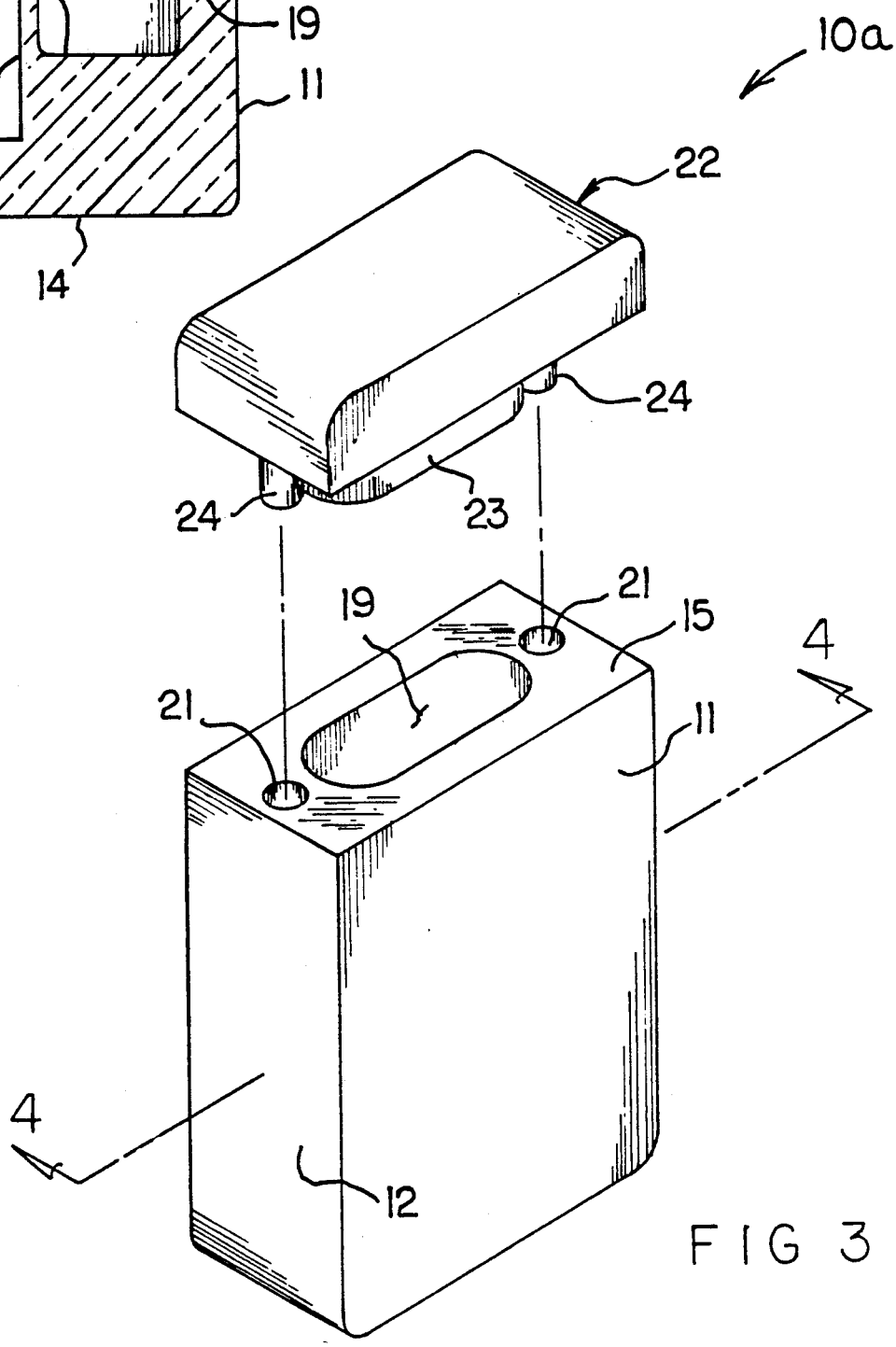
FIG. 3 is an isometric illustration of a modified aspect of the invention.

The invention 10*a*, as indicated in FIGS. 3 and 4 for example, includes a second end wall cavity directed into the second end wall 15, having a second end wall cavity floor 20. Registration bores 21 are directed into opposed sides of the end wall cavity 19 within the second end wall 15. A cap member 22 is provided, having a cap member lug 23 arranged for complementary reception within the second end wall cavity 19 for compression of bar soap pieces directed into the cavity 19. Registration bores 21 receive each a cylindrical alignment rod 24 of the cap member 22 to maintain alignment and registration of the cap member 22 to minimize deformation of the second end wall when the cap is directed therein, and more particularly, the cap member lug 23.

Figure 5:
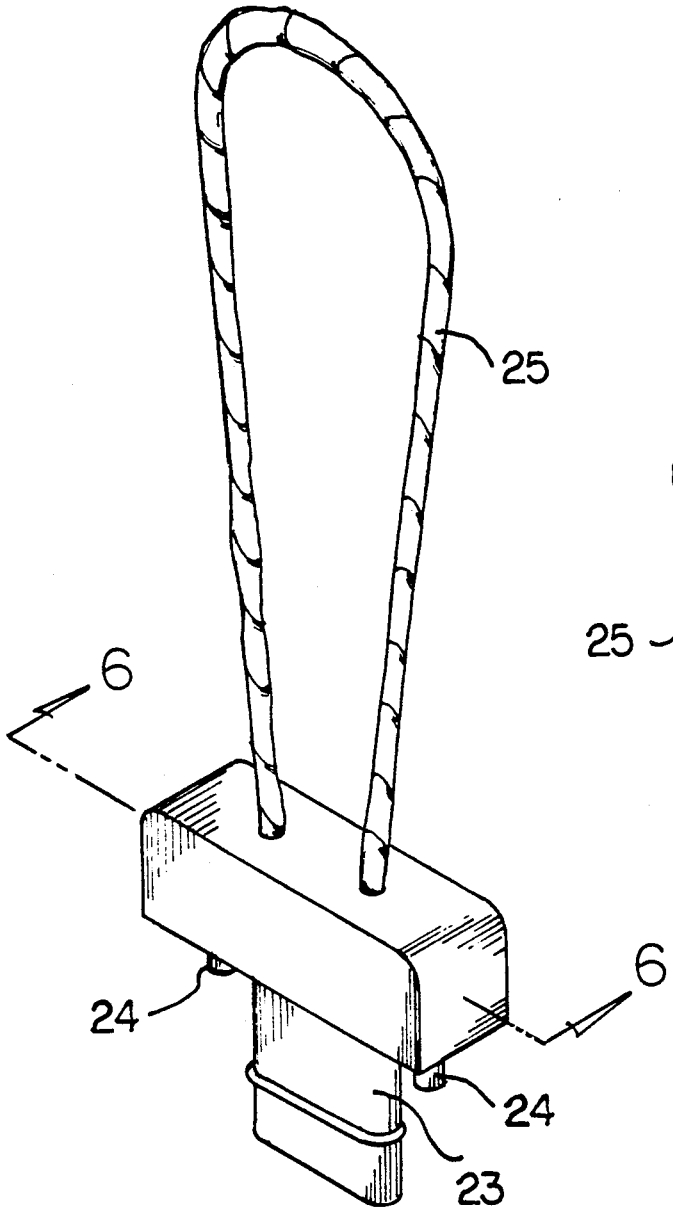
FIG. 5 is an isometric view of an end cap member arranged for employment with the bar soap as indicated in FIG. 3.
Figure 6:
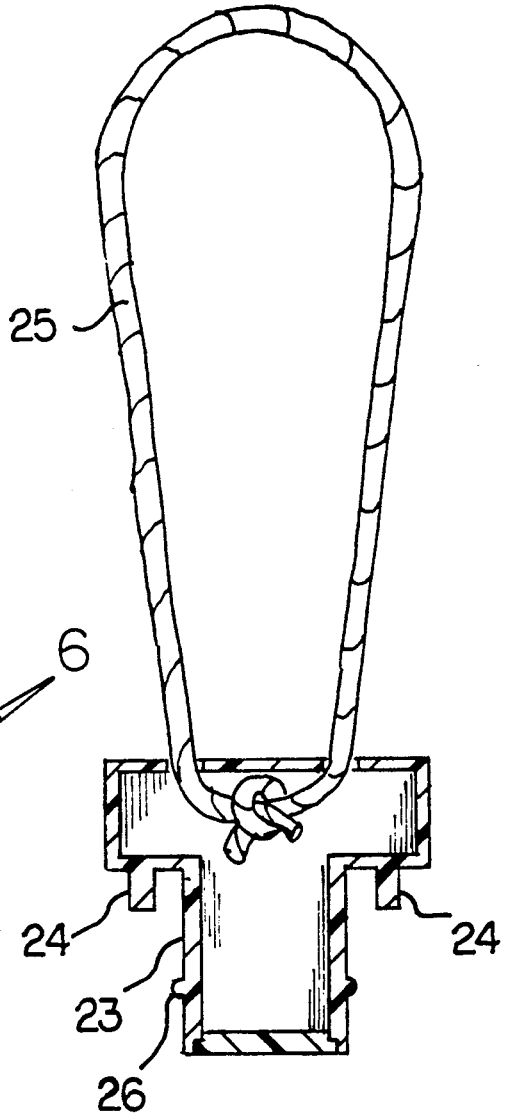
FIG. 6 is an orthographic view, taken along the lines 6—6 of FIG. 5 in the direction indicated by the arrows.

The FIGS. 5 and 6 indicate the use of a cap structure to further include a support tether loop 25 for ease of manipulation of the cap member, with all annular lock rib 26 arranged inn surrounding relationship relative to the cap member lug 23 to maintain frictional engagement within the second end wall cavity 19.

Figures 7, 8, 9:
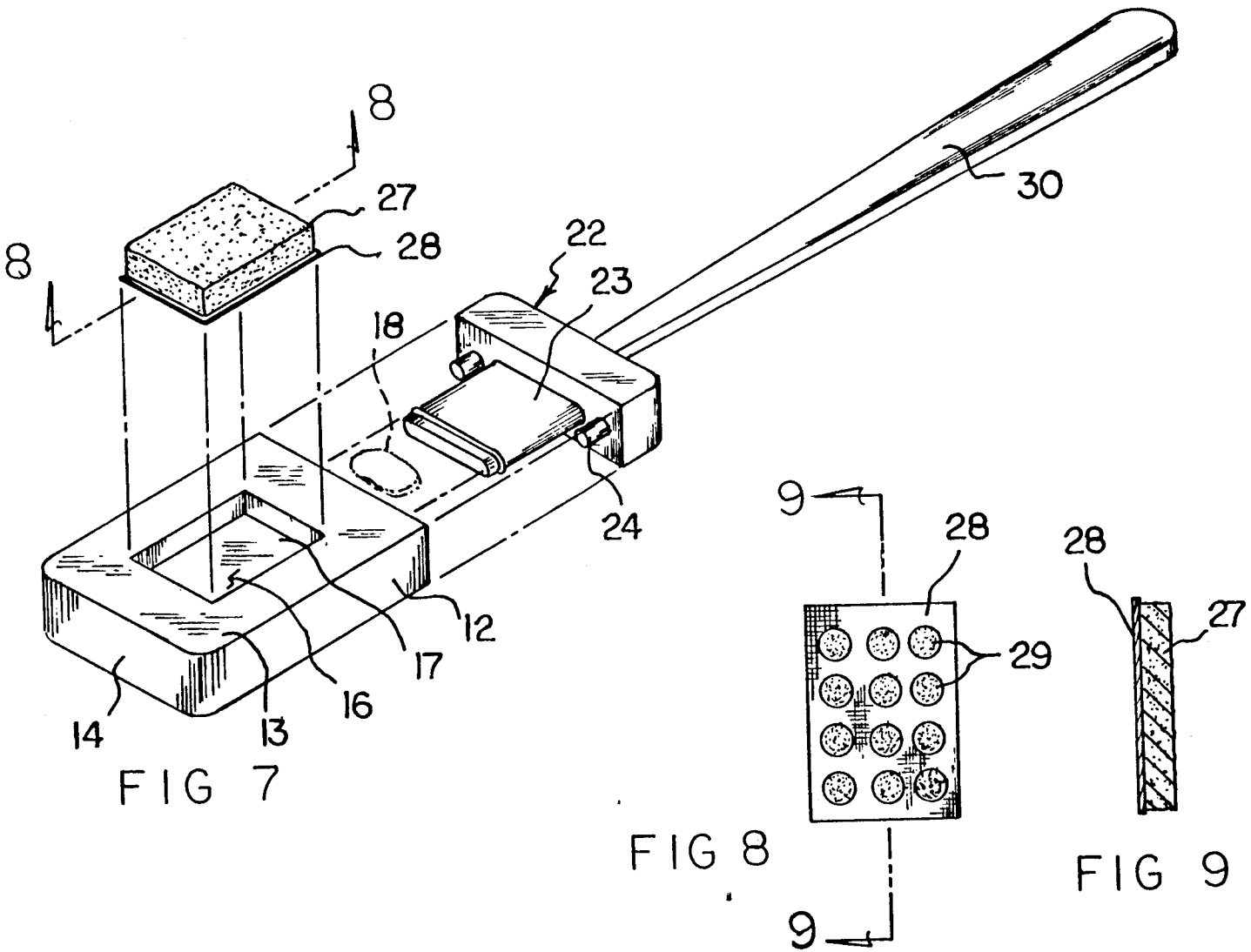
FIG. 7 is an isometric illustration of a further aspect of the invention.
FIG. 9 is an orthographic view, taken along the lines 9—9 of FIG. 8 in the direction indicated by the arrows.

The FIGS. 7-9 indicates that the top wall cavity 16 in the embodiment of 10*a* is arranged to receive a sponge member 27 to further enhance the ease of a bathing procedure by use of directing the sponge member about an individual to enhance the cleaning action. The sponge member 27 is arranged for reuse and to this end, includes a mesh web base 28 having a plurality of mesh web apertures 29 through the base web, wherein moistening of the top wall cavity floor 17 directs soap through the apertures 29 to secure the mesh web base and accordingly, the sponge member 27 within the top wall cavity 16. The cap structure 22, as indicated in FIG. 7, is provided with a rigid handle rod 30 to ease projection of the various soap pieces 18 directed into the second end wall cavity 19.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A bar soap construction, comprising, a soap bar, having a bottom wall spaced from a top wall, spaced side walls, a first end wall, and a second end wall spaced from the first end wall, and a top wall cavity directed into the top wall, with the top wall cavity including a top wall cavity floor spaced from the bottom wall, wherein the top wall cavity is arranged to receive soap pieces within the top wall cavity for their remolding within the top wall cavity, and further including a sponge member, the sponge member having a mesh web base, the mesh web base including a plurality of base apertures directed therethrough, with the mesh web base arranged for positioning upon the top wall cavity floor to receive moistened soap from the top wall cavity floor through the mesh web apertures to lock the mesh web base to the top wall cavity floor.

2. A bar soap construction as set forth in claim 1 including a second end wall cavity directed into the second end wall, having a second end wall cavity floor spaced from the first end wall, and a plurality of registration bores directed into the second end wall on opposed sides of the second end wall cavity, and a cap member, the cap member having a cap member lug arranged for complementary reception within the second end wall cavity, and the cap member including a plurality of cylindrical alignment rods, with each alignment rod arranged for reception within one of said registration bores for alignment of the cap member lug for reception within the second end wall cavity.

3. A bar soap construction as set forth in claim 2 including an annular lock rib mounted to the cap member lug for frictional engagement of the cap member lug within the second end wall cavity.

4. A bar soap construction as set forth in claim 3 wherein the cap member includes a rigid handle rod fixedly mounted to the cap member to provide for manual manipulation of the cap member in directing the cap member lug within the second end wall cavity.

* * * * *